United States Patent [19]

Kaufman

[11] 4,373,675

[45] Feb. 15, 1983

[54] METHOD FOR BENEFICIATING DUCTILE SCRAP METAL

[75] Inventor: Sydney M. Kaufman, Livonia, Mich.

[73] Assignee: Ford Motor Company, Dearborn, Mich.

[21] Appl. No.: 207,176

[22] Filed: Nov. 17, 1980

[51] Int. Cl.[3] ..... B02C 17/00

[52] U.S. Cl. ..... 241/23; 241/26; 241/29; 241/30; 29/403.2; 419/33

[58] Field of Search ..... 241/30, 27, 24, 26, 241/23, 73, 17, DIG. 37, 182, 183, 184, 74, 176, 177, 178, 299, 91, 85, 29; 75/251, 213

[56] References Cited

U.S. PATENT DOCUMENTS

| | | | |
|---|---|---|---|
| 1,455,456 | 5/1923 | Sweet et al. . | |
| 1,539,237 | 5/1925 | Borcherdt | 241/183 X |
| 2,453,008 | 11/1948 | Fowler | 241/101.4 |
| 3,404,846 | 10/1968 | MacPherson et al. . | |
| 4,018,633 | 4/1977 | Holland | 241/DIG. 37 |
| 4,065,060 | 12/1977 | Booz | 241/30 X |
| 4,150,750 | 4/1979 | Sawasky | 241/170 X |

*Primary Examiner*—Mark Rosenbaum

*Attorney, Agent, or Firm*—Joseph W. Malleck; Olin B. Johnson

[57] ABSTRACT

A method is disclosed of converting tangled ribbons of ductile machining scrap into a densified intermediate product useful for making metal powder. A collection of the scrap having a packing density less than 50 lbs/ft$^3$ is subjected to impacting forces between weighted, freely moving elements and an anvil means for progressively flattening the scrap. The impacting is repeated to substantially flatten all of the scrap and reduce some of the ribbons by fatigue breakage to chips; the resulting processed scrap will have a packing density in excess of 90 lbs/ft$^3$.

14 Claims, 6 Drawing Figures

10
11
(a)
(b)
(c)
40
(d)
41
(e)
42
(f)
44
(g)
45

METHOD FOR BENEFICIATING DUCTILE SCRAP METAL

BACKGROUND OF THE INVENTION

A considerable amount of scrap metal that is generated as a result of metal machining in industries today is in the form of ductile milling stringers. The stringers are continuous ribbons of metal which have been sheared off by a milling/cutting operation on ductile metal stock. The stringers are not easily broken due to their ductility and therefore form long curled ribbons which, when heaped together as scrap, form an entangled commodity with a very low packing density.

Such ductile tangled millings have been consistently downgraded in economic value due to their limited utility. Batches of such scrap material have been used in ladles or ingot vessels as a cushion for dropping heavy solid scrap thereon which, in turn, protects the refractory lining of such ladles or vessels. Such scrap has also been alternatively hot pressed into a bale which removes the oils from such milling scrap so that the bale can be fed as a raw ferrous material to an electric furnace for melting. Apart from such uses, the scrap has almost no value. Attempts to use such scrap for making powder metal have not met with success. This is principally due to the fact that in attempting to comminute the stringers, they become jammed in a hammer mill or other pulverizing device. Such jamming, of course, results from their ductility which inhibits fracture. Moreover, the tangled scrap usually has foreign debris mixed into it as a result of loose scrap keeping habits. Such debris usually consists of large pieces of solid metal which damage the pulverizing or comminuting device rather easily.

What is needed is a method that can economically convert such entangled ductile milling ribbons to a usable metal commodity without the necessity of melting so that it can be directly recycled for use in making metal products.

SUMMARY OF THE INVENTION

The present invention is a method of converting ductile tangled ribbons of machining scrap into a densified intermediate product useful for making powder metal. The method comprises subjecting a collection of ductile tangled ribbons of machining scrap having a packing density less than 50 pounds per cubic foot to impacting forces between weighted, freely moving elements and an anvil means for progressively flattening such scrap. The impacting is repeated until the machining scrap is comprised of a collection of substantially flattened chips having a packing density in excess of 90 pounds per cubic foot.

The weighted elements used in the impacting process are preferably comprised of solid steel balls having a diameter of 1–2.5 inches; the anvil means is preferably the wall of a rotating chamber containing the collection of scrap and balls. Although the ductile scrap is principally flattened as a function of the method, there is a certain limited amount of ductile fatigue breakage that takes place, shortening the ribbons to chips. In addition, if the process is repeated sufficiently long enough, some degree of abrasion of the weighted elements takes place so that they are eventually reduced to fragments along with the ribbons.

Alternatively, the weighted elements may comprise, in part, heavy chunks of metal debris which had previously become mixed with the ribbon-like scrap, such chunks, by their very weight, serving to act as a hammer or flattening agent. To facilitate the hammering and flattening effect the anvil means is preferably comprised of a drum having a diameter larger than the length thereof, and particularly at least one to two times larger. For example, the drum may have a diameter of 36" and a length of about 20". It is desirable that the drum be rotated at a speed typically in the range of 35–45 RPM so that the path of circulation or trajectory of the balls will provide a drop of approximately 12 inches.

The intermediate product may be processed further in accordance with a complete conversion of the material to a selected powder metal or part. Such further steps include heat treating the flattened chips to a brittle condition and sequentially shreading and pulverizing the material to a density of about 160 lbs. per cubic foot. The pulverized particles may then be coated with a suitable diffusion barrier, such as copper, to facilitate lower temperature sintering. The powder may then be compacted to a predetermined size and subjected to a sintering operation to form a completed powder metal part.

DETAILED DESCRIPTION

The starting material for the present method is ductile tangled ribbons 10 of machining scrap. These entangled ribbons are produced as the result of shear machining of solid stock metal by milling, boring, turning and other related machining methods; the shearing tool is moved relative to the stock to produce a sliver of metal that is eventually severed from the stock. The scrap, which is the subject of the method, is of a ductile type that usually comprises all forms of ferrous material having a chemistry conforming to that described in chapter 51 of "The Making, Shaping and Treating of Steel", published by United States Corporation, 1971, printed by Herbich and Held. The disclosure of chapter 51 is incorporated herein by reference. For purposes of this invention, ductile scrap is that scrap which is equivalent to all machining steels commercially available. Such scrap is typically coated with oil as a result of the machining operation.

Due to the springy physical character of the entangled scrap, it is difficult to separate the ribbons 10 by normal screening or shredding techniques because the ribbons will become entangled with the elements that are attempting to do the shredding; the ribbons are ductile and do not fracture by a brittle breakage. In addition, the presence of heavy chunks of material as foreign debris in the collection usually cause damage to the device attempting to shread the material. Such heavy chunks arise as a result of collection techniques. During the collection of such scrap, it is thrown into bins with a variety of other debris which may include heavy chunks of metal, stock that is broken off, or even unwanted pieces of tooling which have found their way into the scrap collection.

Ball milling technology is not effective to operate upon such scrap because of the ductile nature of the material, the balls failing to grind or break the material according to standard ball mill technology. Thus, shredding, grinding and ball milling being incapable of beneficiating such scrap, a new mode is necessary.

Figure 1:
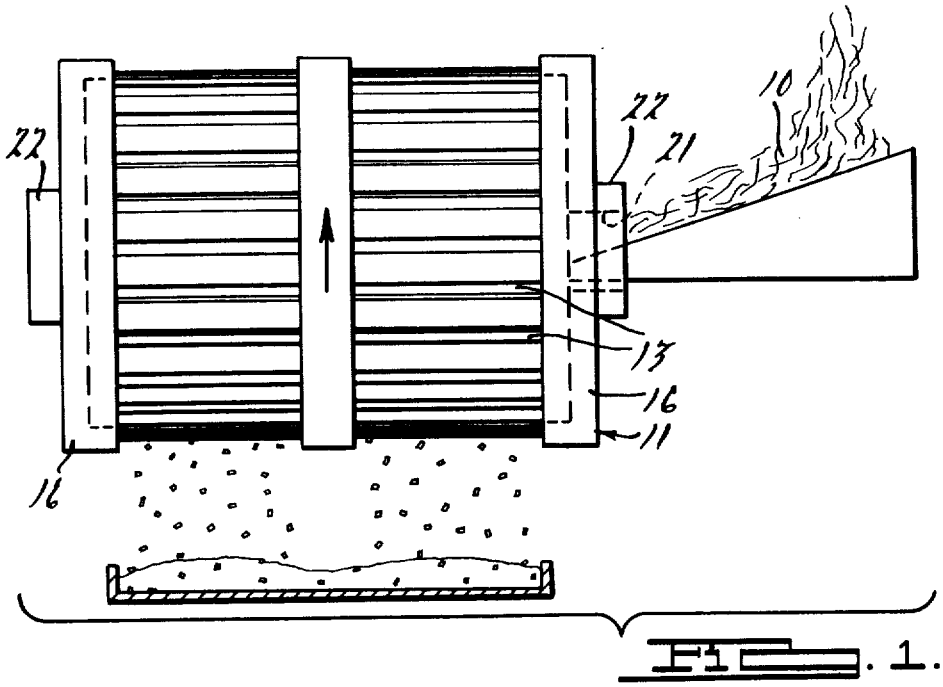
FIG. 1 is a schematic front elevational view of a continuous impacting metal depicting the principal mode of the invention.
Figure 2:
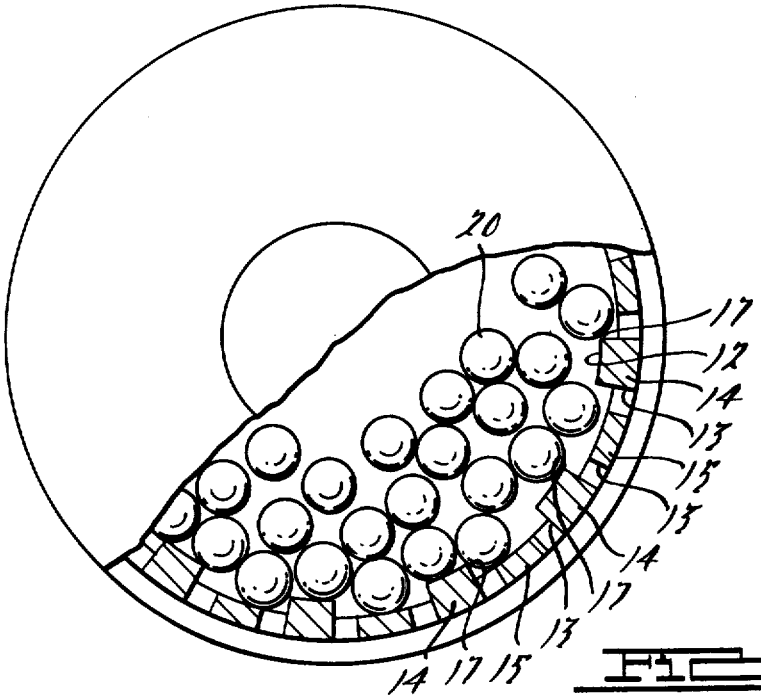
FIG. 2 is an end view of the structure shown in FIG. 1, partly broken away to illustrate the interior thereof.

This invention has discovered that by subjecting the collection of ductile tangled machining scrap, having a packing density of less than 50 lbs. per cubic foot, to impacting forces between weighted, freely moving elements on the one hand and an anvil means on the other hand, progressive flattening of the scrap takes place and an intermediate product of significant usefullness can be achieved. A preferred mode for providing such impacting forces is shown in FIGS. 1 and 2; it comprises a rotating drum 11, here having an interior surface 12, operating as an anvil means. The surface is interrupted to have slotted slide openings 13 defined by a series of bars 14 and 15 extending between supporting end plates 16 of the drum. Bars 14 have a heavier cross-section than bars 15 to form an interior ridge 17 which can catch and move the material resting thereagainst on the interior of the drum. The spacing between the bars is typically about 0.5", but can be varied according to the type of scrap that is to be processed, particularly the width thereof.

The weighted, freely moving elements 20 are preferably comprised of heavy steel balls in the form of spherical shapes, each having a diameter of 1–2.5 inches. The weighted elements preferably have a uniform size, but can be varied within the range to give the impacting forces required.

The drum has a large opening 21 (about one-third the diameter of the mill) through the journal 22 for rotation of the drum; scrap is fed through the opening on a continuous basis. The drum is normally rotated at a speed within the range of 35–45 rpm, which is comparable to the speeds normally used in ball milling operations. However, during the process whereby the balls are repeatedly impacted against the ribbons, no grinding will take place as in ball mill technology. The principal effect that will operate upon the entangled ribbons is that of flattening by each drop of a weighted element onto the scrap as it is caught against a bar or side of the rotating drum. The hammering effect of the weighted element will progressively flatten each of the ribbons over a predetermined period of time. Such ribbons will be shortened by breakage due to ductile fatigue. Such impacting device may be operated for continuous periods of time, using a very small electric motor (for example, a five horsepower motor).

It has been found that the diameter of the drum or anvil means should be considerably larger than the length thereof in order to emphasize the dropping of the balls freely onto the scrap and against the drum, rather than a cascading of the balls upon themselves. Without such movement and freedom to drop separately, the function of flattening would be inhibited.

It has been found that the optimum density of the starting scrap should be in the range of 20 to 40 lbs. per cubic foot. When subjected to repeated impacting for a period of about 25 minutes with impacting forces in the range of 1 to 3 ft/lbs, the scrap will be converted to an intermediate product having a packing density of about 100 lbs. per cubic foot.

The data from specific tests carrying out the above product is shown in Table I, below. In such test, the drum had a diameter of 32 inches and a length of 24 inches. The interior volume of the drum was 11.17 cubic feet and the weighted elements were steel balls having a diameter of 2½ inches. In all runs, the test was carried out for a period of 20 minutes. In test run #1, it is noted that the highest number of balls was employed providing a total impacting mass of 614 lbs. Such balls occupied approximately 21% of the interior volume of the drum. A charge of scrap weighing 19 lbs. was added to the drum having an initial packing density of about 21 lbs. per cubic foot. The drum was rotated for a test time of 20 minutes at the end of which the product was sampled and weighed, providing the final scrap density as indicated. The number of balls were progressively reduced in test runs #2 and #3. The final scrap density did not vary substantially, except for a reduction of about one pound per cubic foot. From these tests, it can be concluded that a significant beneficiation can be made to a ductile tangled collection of metal ribbons by the process herein.

Figure 3:
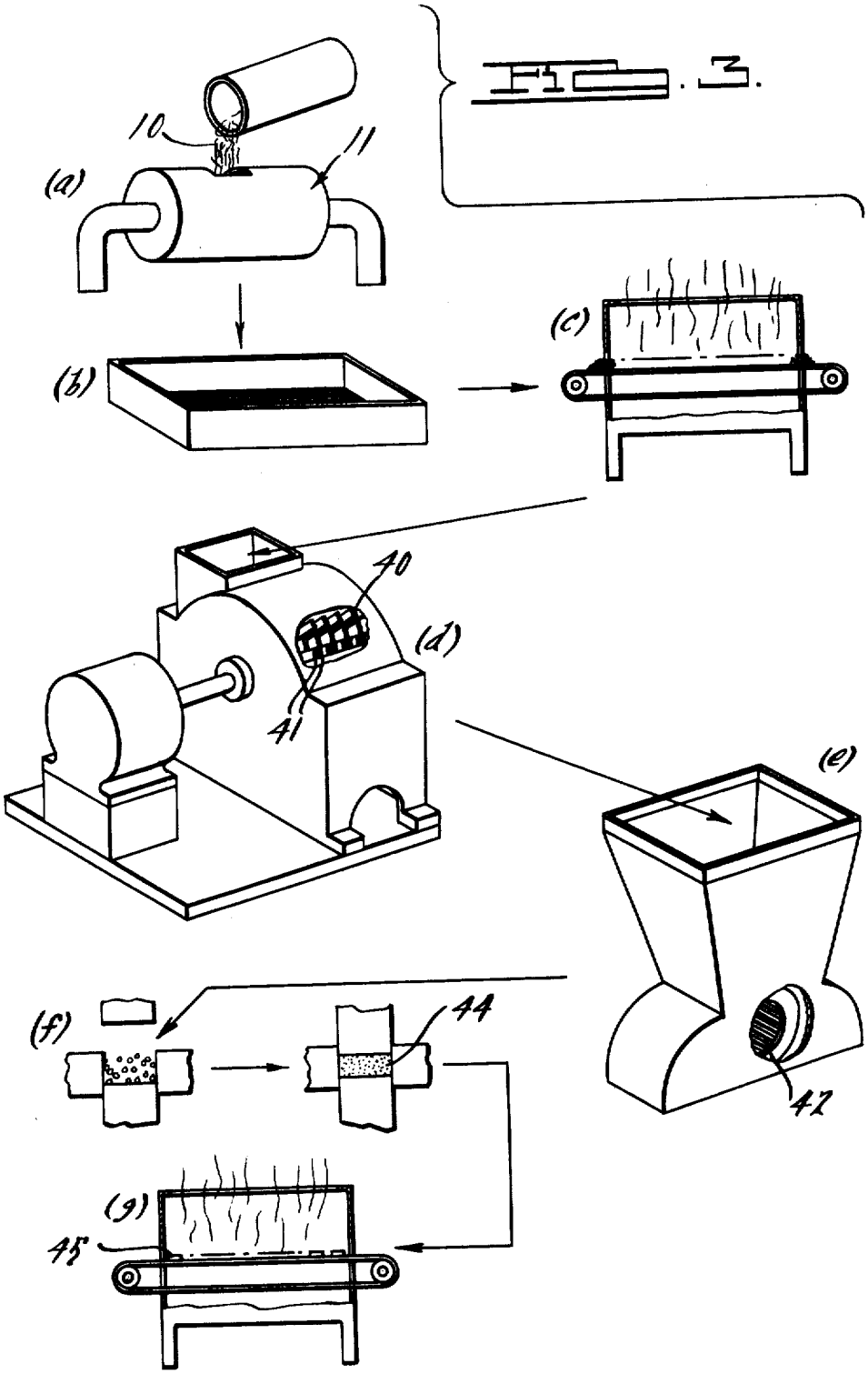
FIG. 3 is a schematic method sequence diagramming the steps for converting a raw supply of tangled ductile milling scrap to a powder metal product of a predetermined configuration.

In FIG. 3, a flow diagram is presented that shows how the beneficiation steps of this invention are uniquely useful in the making of powder metal and sintered parts from such ductile machining scrap. In step (a), the collection of ductile tangled ribbon machining scrap 10, having a packing density of less than 50 lbs/ft$^3$, is subjected to freely moving elements in drum 11 (anvil means) to flatten and break said scrap into flat chips having a packing density in excess of 90 lbs. The chips may be screened (in step b) to remove some odd shaped pieces and the passed material subjected to heat treatment (step c) to brittlize the chips. The treated chips are then subjected to a hammer mill (step d) to shred the chips to a packing density of about 120 lbs/ft$^3$. Swinging hammer elements 40 cut the chips between edges 41 to shred the chips. The shredded chips are then subjected to a pulverizing mill (step e) to reduce the material to a powder having a packing density of about 160 lbs/ft$^3$. A pulverizing mill typically spins the material around inside a cage 42 at high speed which forces the material outwardly against an annular array of grinding and cutting elements. The powder may be further subjected to a ball milling operation, utilizing iron or copper ball milling elements, to coat the powder particles with a carbon diffusion barrier of iron or copper and raising the packing density to about 180 lbs/ft$^3$. Then, the uncoated powder or coated powder mixed with low carbon powder can be compacted with a predetermined amount of graphite powder (step f) to a predetermined preform shape 44, followed by sintering (step g) using the high carbon powder as a liquid phase to provide a substantially fully dense metal product 45.

Figure 4:
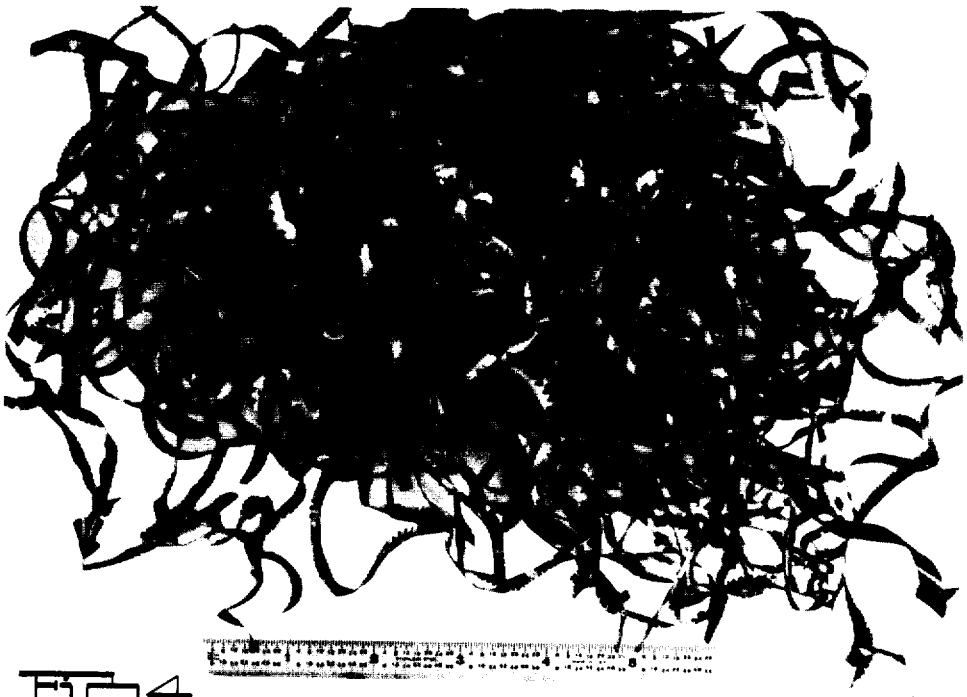
FIGS. 4–6 are photographs on a scale of about 1:1 of respectively (a) the raw entangled ductile scrap prior to treatment according to this method, (b) a weighted steel element for impacting as used in the process herein, and (c) the resulting comminuted intermediate product resulting from the practice of the method.
Figure 5:
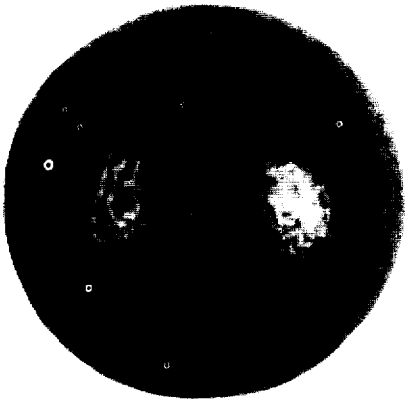
Figure 5:
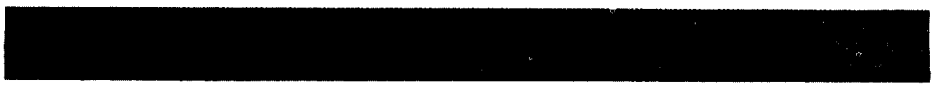
Figure 6:
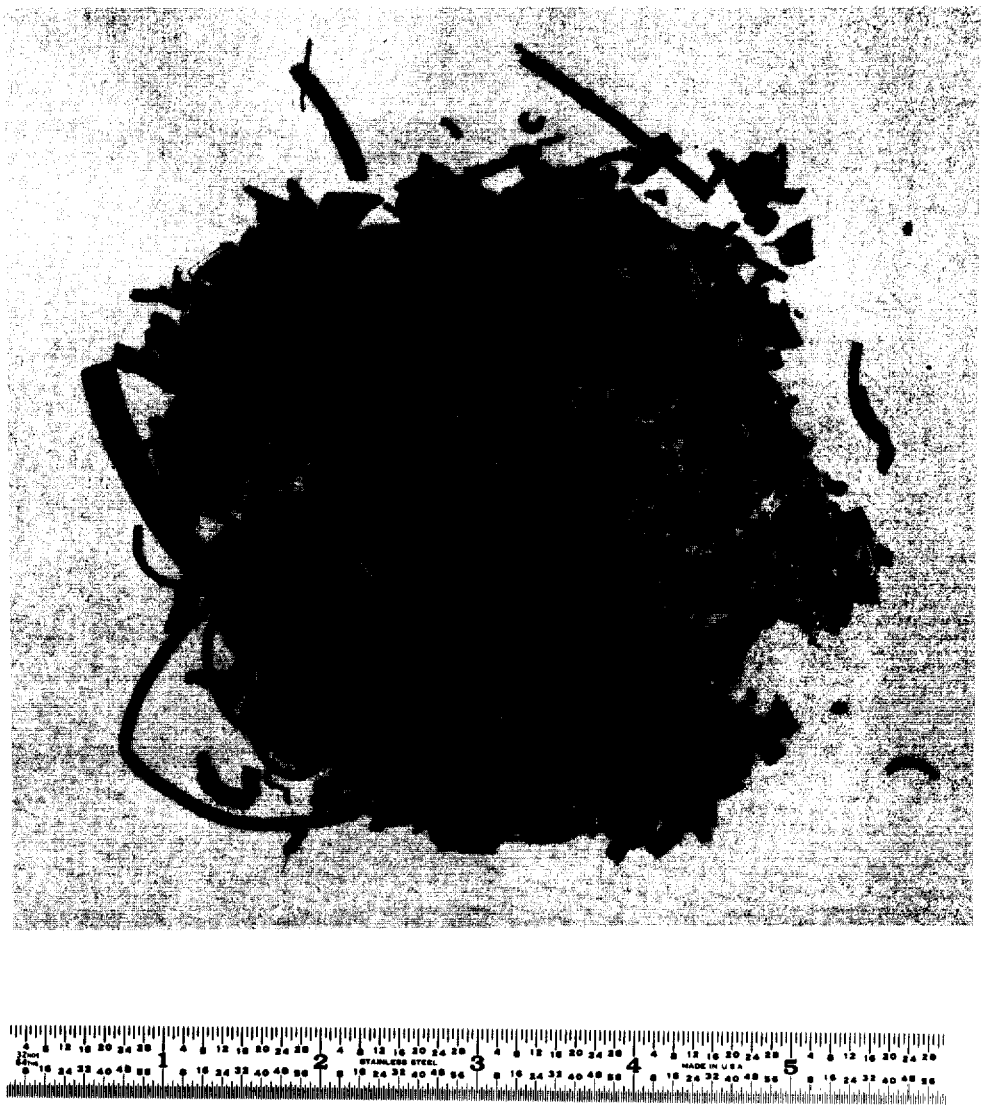

FIGS. 4, 5 and 6 give a visual representation of the scrap material before and after, and the element used to carry out impacting for flattening ductile ribbons. FIG. 4 shows a supply of ductile tangled machining ribbons (SAE 1006 steel) weighing about 180 grams and having a packing density of 20 lbs/ft$^3$. FIG. 5 shows a 2.5" diameter steel ball used as one of the flattening elements (the rule below is in inches). FIG. 6 shows the resulting flattened material from a flattening sequence having a packing density of 98 lbs/ft$^3$.

TABLE I

| Test Run No. | No. of Balls | Wt. of Balls | % of mill vol. occupied by balls | Scrap chg. wt. | Initial scrap density lb/ft$^3$ | Final scrap density lb/ft$^3$ |
|---|---|---|---|---|---|---|
| 1 | 273 | 614 lbs | 21% | 19 lbs | 21 | 100 |
| 2 | 233 | 524 lbs | 17% | 40 lbs | 21 | 99 |
| 3 | 200 | 450 lbs | 13.5% | 60 lbs | 21 | 98 |

I claim:

1. A method of hammering ductile tangled ribbons of machining scrap into a densified intermediate product, comprising:

(a) subjecting a collection of said ductile tangled ribbons of machining scrap having a packing density of less than 50 lbs. per cubic foot to impacting forces between weighted, freely moving elements and an anvil means, said impacting forces being applied to progressively flatten said scrap;

(b) repeating said impacting until said machining scrap is comprised of a collection of substantially flattened fragmented ribbons having a packing density in excess of 90 lbs. per cubic foot.

2. The method as in claim 1, in which the weighted elements are comprised of solid steel balls having a diameter in the range of 1–2.5 inches and said anvil means is comprised of a wall of a rotating chamber containing the collection of scrap and balls.

3. The method as in claim 1, in which the weighted elements abrade against the other weighted elements and steel ribbons to form particles which become mixed with the flattened fragmented ribbons.

4. The method as in claim 1, in which the ribbons of ductile scrap are comminuted by ductile fatigue failure into shorter ribbons or chips.

5. The method as in claim 1, in which in step (a), a continuous supply and extraction of the collection scrap is subjected to impacting in a continuous mode, and the anvil means is comprised of a drum having slots through which the comminuted ribbons are extracted.

6. The method as in claim 1, in which the packing density of the collection of machining scrap is about 20 lbs. per cubic foot and the resulting packing density of the flattened fragmented ribbons is in excess of 100 lbs. per cubic foot.

7. The method as in claim 1, in which at least some of the weighted elements are heavy chunks of metal debris forming part of the original scrap supply.

8. The method as in claim 1, in which said repeating of said impacting forces provides minute hammering of the tangled ribbons of scrap, said minute hammering being carried out for a period of at least 20 minutes.

9. The method as in claim 1, in which step (a) is carried out with said anvil means in the form of a drum having a diameter significantly larger than the length of said drum.

10. The method as in claim 1, in which the weighted elements are moved by operation of the anvil means to have a circulatory path permitting the balls to recirculate substantially free of each other and impact against the anvil means.

11. A method of making powder metal fromm ductile machining scrap metal, comprising:

(a) hammering a collection of ductile tangled ribbon machining scrap having a packing density of less than 50 lbs. per cubic foot by subjecting said scrap to impacting forces between weighted, freely moving elements and an anvil means, said impacting being repeated until said machining scrap is flattened and comprised of a collection of substantially flat fragmented ribbons having a packing density in excess of 90 lbs. per cubic foot;

(b) heat treating said flattened fragmented ribbons to a brittle condition; and (c) sequentially shredding and pulverizing said fragmented ribbons to a packing density of about 160 lbs. per cubic foot.

12. The method as in claim 11, in which the process is additionally comprised of coating the pulverized particles of step (c) with an element selected from the group consisting of copper and iron, said coating operating as a diffusion barrier during subsequent liquid phase sintering.

13. The method as in claim 12, in which said method further comprises again pulverizing the coated powder, compacting the powder to a predetermined preformed shape, and finally sintering of said preformed shape to a substantially fully dense metal product.

14. The method as in claim 11, in which the anvil means is comprised of a drum having slotted openings therein, the width of said slots operating as a control of the maximum size of the ribbons or chips.

* * * * *